US006924764B1

(12) United States Patent
Chen

(10) Patent No.: US 6,924,764 B1
(45) Date of Patent: Aug. 2, 2005

(54) DYNAMIC INFORMATION MONITORING SYSTEM EMPLOYING ACCELERATION SIGNAL AND GLOBAL POSITIONING SIGNAL FOR SKIING EXERCISE

(76) Inventor: Yu-Yu Chen, 2Fl., No. 349, Wushing St., Shinyi Chiu, Taipei (TW), 110

( * ) Notice: Subject to any disclaimer, the term of this patent is extended or adjusted under 35 U.S.C. 154(b) by 0 days.

(21) Appl. No.: 10/833,081

(22) Filed: Apr. 28, 2004

(51) Int. Cl.[7] ..... H04B 7/185
(52) U.S. Cl. ..... 342/357.07; 342/357.06
(58) Field of Search ..... 342/357.01, 357.06, 342/357.07, 357.09; 701/207, 213; 702/36, 44, 56

(56) References Cited

U.S. PATENT DOCUMENTS 6,266,623 B1 * 7/2001 Vock et al. ..... 702/44

* cited by examiner

*Primary Examiner*—Dao Phan
(74) *Attorney, Agent, or Firm*—Rosenberg, Klein & Lee

(57) ABSTRACT

A dynamic information monitoring system for skiing exercise includes an acceleration sensing module for detecting an acceleration signal of a skier during skiing, a GPS signal receiving module for receiving a GPS signal, a microprocessor for receiving the GPS signal received by the GPS signal receiving module and the acceleration signal detected by the acceleration sensing module, and a display unit connected to the microprocessor for showing dynamic information about a skier in skiing. The microprocessor converts data strings of the speeds over ground or times and coordinate positions in the GPS signal received by the GPS signal receiving module into real moving speeds of the skier during skiing, and calculates the acceleration of the ski. The uphill and/or downhill inclination angle and height of a ski of the skier is calculated based on the acceleration of the ski, the acceleration signal received by the acceleration sensing module as well as the acceleration of gravity.

5 Claims, 8 Drawing Sheets

DYNAMIC INFORMATION MONITORING SYSTEM EMPLOYING ACCELERATION SIGNAL AND GLOBAL POSITIONING SIGNAL FOR SKIING EXERCISE

BACKGROUND OF THE INVENTION

1. Field of the Invention

The present invention relates to a dynamic information monitoring system employing acceleration signal and global positioning system (GPS) signal for skiing exercise, and more particularly to a monitoring system capable of detecting dynamic information about a skier's speed, inclination, height, and coordinate position during skiing.

2. Description of the Prior Art

Skiing is a popular exercise among many people. Generally, a skier does not know dynamic information about himself during skiing. There are manufacturers who mount a speed sensor on a ski to detect the skier's speed. However, the speed sensor mounted on the ski provides only very simple function of showing the speed without the capability of showing information about the skier's uphill or downhill inclination angle, relative height, etc.

While positioning techniques using the global positioning system (GPS) have been employed to detect the speed, movement, or height of a user in jogging or doing other outdoor exercises or sports, data obtained with the conventional positioning techniques cannot fully match the sportsmen's real need that frequently varies with different sport activities.

Moreover, there are many factors, including topography, surface features, and weather, that would have reverse influences on the sensitivity of the GPS positioning techniques to therefore result in signal deformation and accordingly inconveniences in using the GPS positioning techniques.

It is therefore desirable to develop a dynamic information monitoring system employing acceleration signal and GPS signal for skiing exercise to meet the user's practical need.

SUMMARY OF THE INVENTION

A primary object of the present invention is to provide a dynamic information monitoring system for monitoring and displaying information about a skier's uphill and/or downhill inclination angle and the like during skiing.

To achieve the above and other objects, the dynamic information monitoring system for skiing exercise according to the present invention mainly includes a microprocessor that converts data strings of the speeds over ground or times and coordinate positions in the GPS signal received by a GPS signal receiving module into real moving speeds of the skier during skiing, and calculates the acceleration of the ski. The uphill and/or downhill inclination angle and other information about the skier in skiing is calculated based on the acceleration of the ski, the acceleration signal received by an acceleration sensing module as well as the acceleration of gravity.

Another object of the present invention is to provide a dynamic information monitoring system for skiing exercise that associates a GPS signal received from the GPS with a GPRS (General Packet Radio Service), a GSM (Global System for Mobile), or a RF (Radio Frequency) mobile communication apparatus, so that a skier may clearly transmit information about his or her speed and position during skiing to a remote central control tower.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
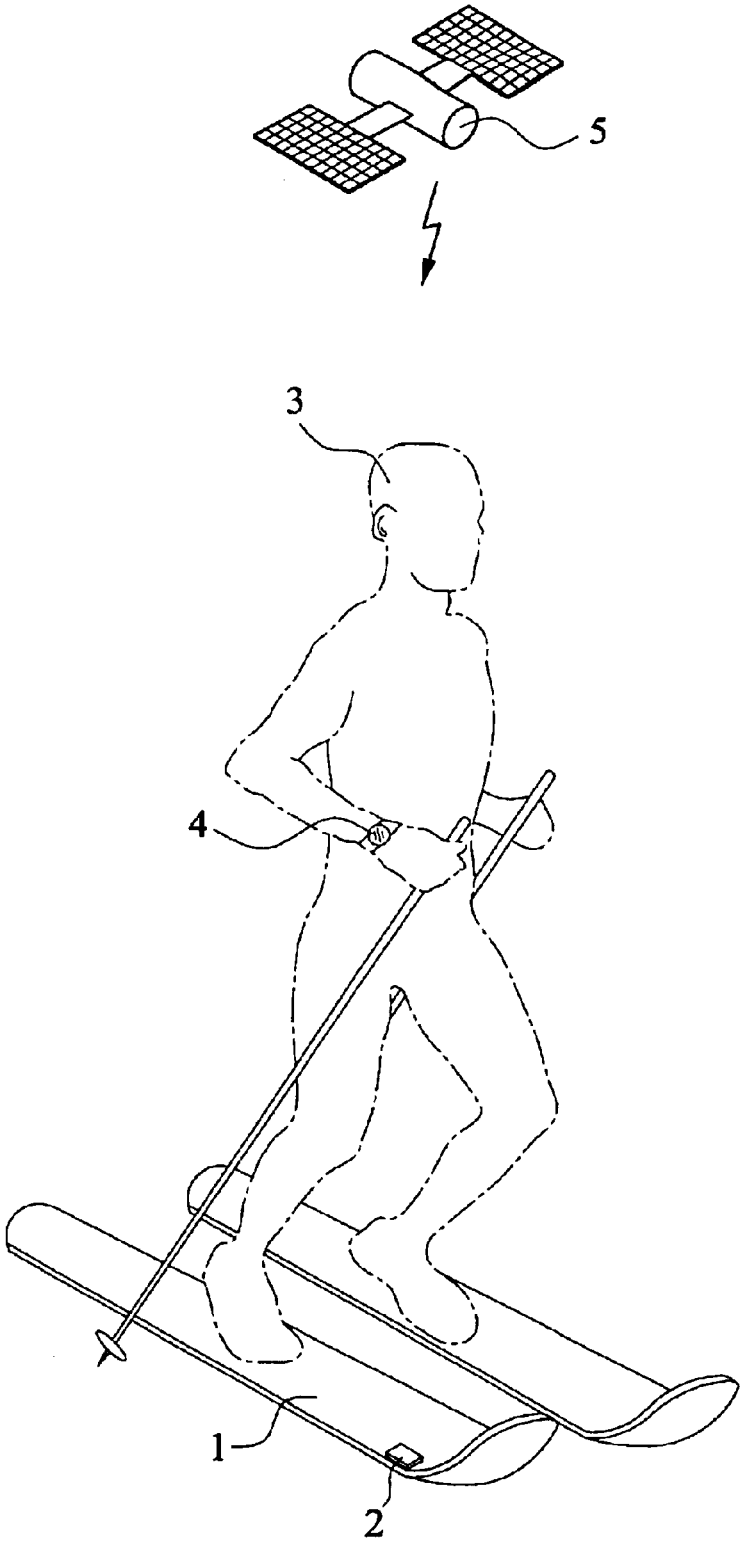
FIG. 1 is a perspective view showing the use of the present invention in dynamic monitoring during skiing.

Please refer to FIG. 1 that is a perspective view showing the use of a dynamic information monitoring system of the present invention in dynamic monitoring during skiing. As shown, a skiing information sensing device 2 is mounted on a ski at a suitable position thereof. The skiing information sensing device 2 is capable of sensing an acceleration of a skier 3 during skiing, and receiving different GPS signals. And, a signal-receiving module 4 is worn on the skier's one wrist.

Figure 2:
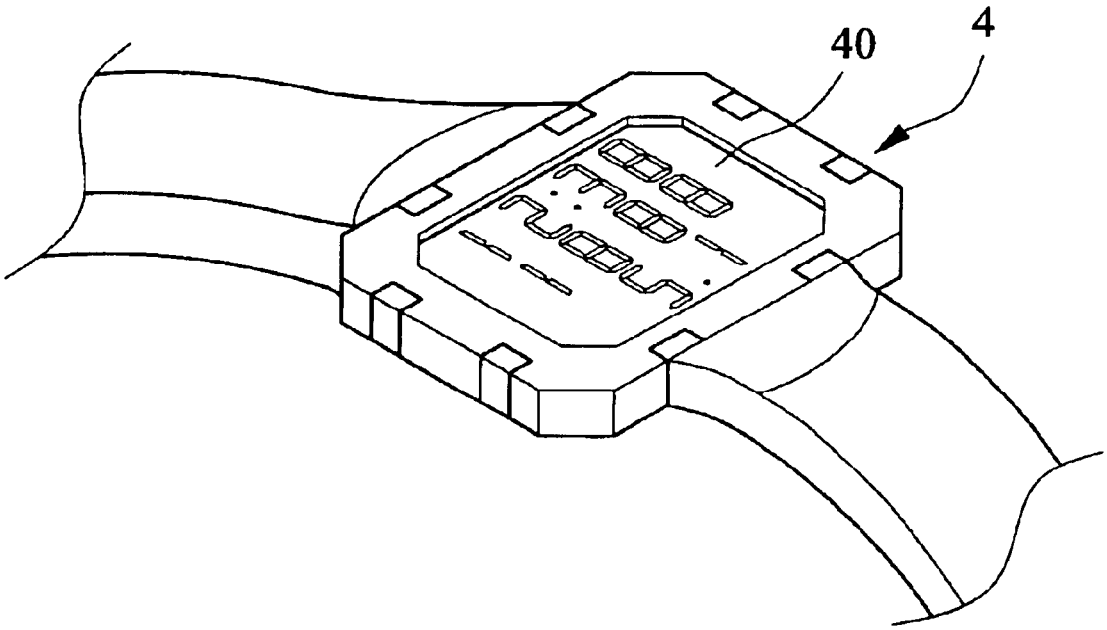
FIG. 2 is an enlarged perspective view of a signal-receiving module included in the present invention.

FIG. 2 is an enlarged perspective view of the signal-receiving module 4, which internally includes a receiving circuit for receiving a signal transmitted from the skiing information sensing device 2 and different GPS signals. A display unit 40 is provided on a top of the signal-receiving module 4 for displaying dynamic information about the skier during skiing.

Figure 3:
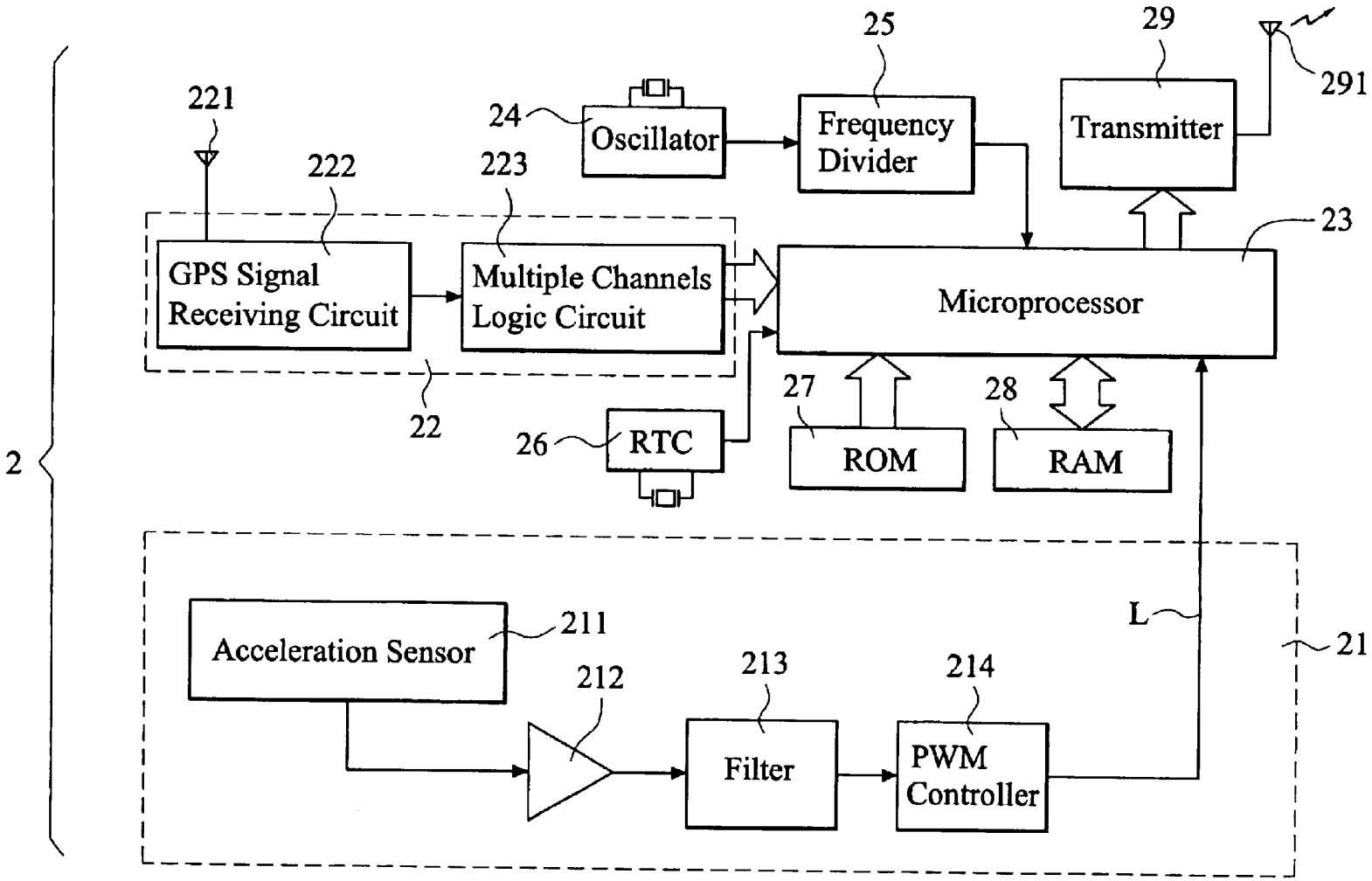
FIG. 3 is a block diagram for a first embodiment of the present invention.
Figure 4:
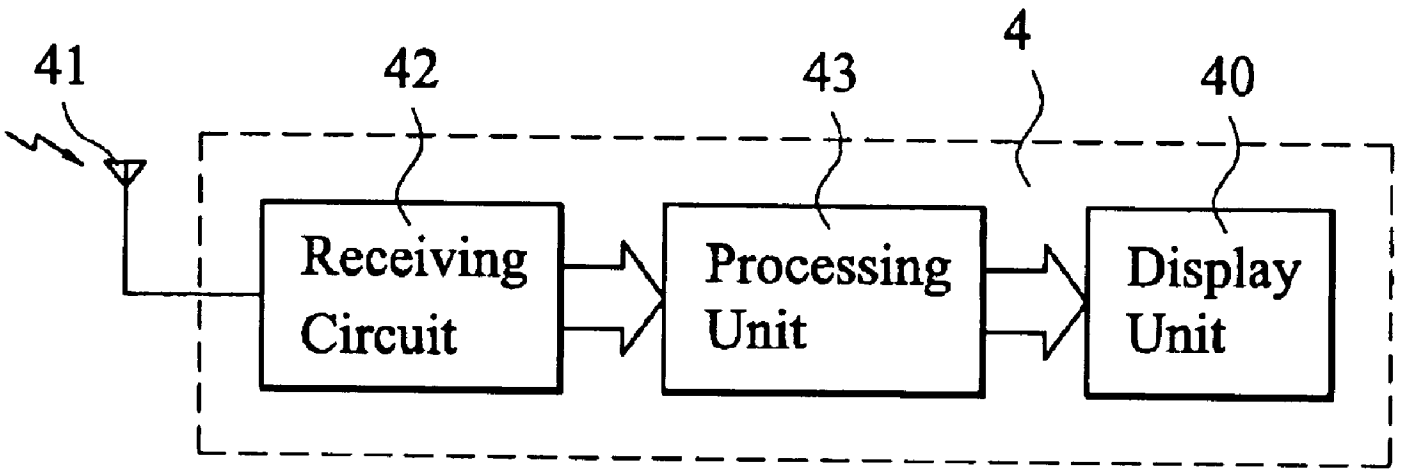
FIG. 4 is a block diagram for the signal-receiving module included in the first embodiment of the present invention.

FIGS. 3 and 4 are block diagrams for a first embodiment of the present invention. As shown, the skiing information sensing device 2 consists of an acceleration sensing module 21 and a GPS signal-receiving module 22. The acceleration sensing module 21 includes an acceleration sensor 211, an amplifier 212, a filter 213, and a Pulse Width Modulation (PWM) controller 214. The acceleration sensor 211 is capable of detecting an acceleration signal from the ski 1 and variations in inclination of a ski. The acceleration signal is amplified at the amplifier 212 and filtered at the filter 213, and the PWM controller 214 outputs the wave shape of the amplified and filtered acceleration signal.

The GPS signal-receiving module 22 includes a GPS signal receiving antenna 221, a GPS signal receiving circuit 222, and a multiple channels logic circuit 223, and is capable of receiving signals transmitted from a satellite 5.

A GPS signal received by the GPS signal receiving circuit 222 via the antenna 221 passes through the multiple channels logic circuit 223 and is sent to a microprocessor 23, which calculates information about the skier's current coordinate position, movement, speed, etc. based on the signal received by the GPS signal receiving circuit 222 and sent to the microprocessor 23.

The microprocessor 23 is connected to an oscillator 24, a frequency divider 25, a real time clock controller 26, a read-only memory (ROM) 27, a random access memory (RAM) 28, and a wireless transmitter 29.

When the microprocessor 23 receives the acceleration signal detected by the acceleration sensing module 21 and the GPS signal detected by the GPS signal-receiving module 22, it calculates and processes the received signals to obtain dynamic information about the skier's coordinate position, speed, uphill and/or downhill inclination angle, and relative height during skiing. Then, the wireless transmitter 29 transmits such dynamic information about the skier's coordinate position, speed, uphill and/or downhill inclination angle, and relative height during skiing via a transmitting antenna 291.

The transmitted dynamic information is received by the signal-receiving module 4 worn on the skier's wrist. FIG. 4 is a block diagram for the signal-receiving module 4 according to a first embodiment of the present invention. The signal-receiving module 4 includes a display unit 40, a receiving antenna 41, a receiving circuit 42, and a processing unit 43. The dynamic information about the skier's coordinate position, speed, uphill and/or downhill inclination angle, and relative height during skiing received by the signal-receiving module 4 from the skiing information sensing device 2 is processed at the processing unit 43 and then displayed at the display unit 40. In the present invention, the processed information is transmitted to the signal-receiving module 4 worn on the skier's wrist through wireless signal transmission, so that the skier may conveniently read the information while skiing.

Figure 5:
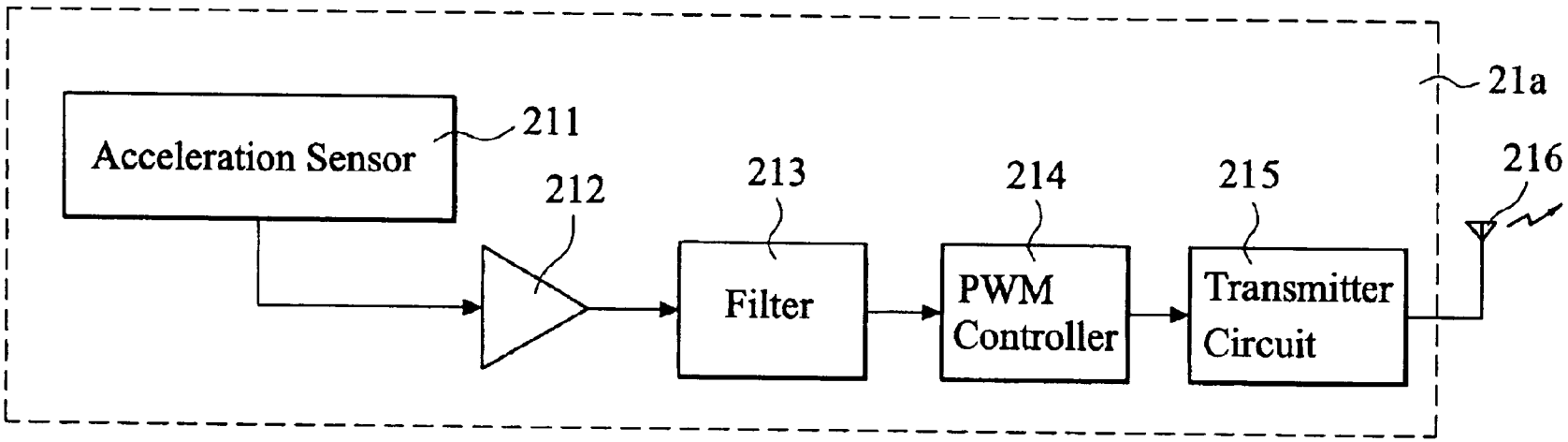
FIG. 5 is a block diagram for a second embodiment of the present invention.
Figure 6:
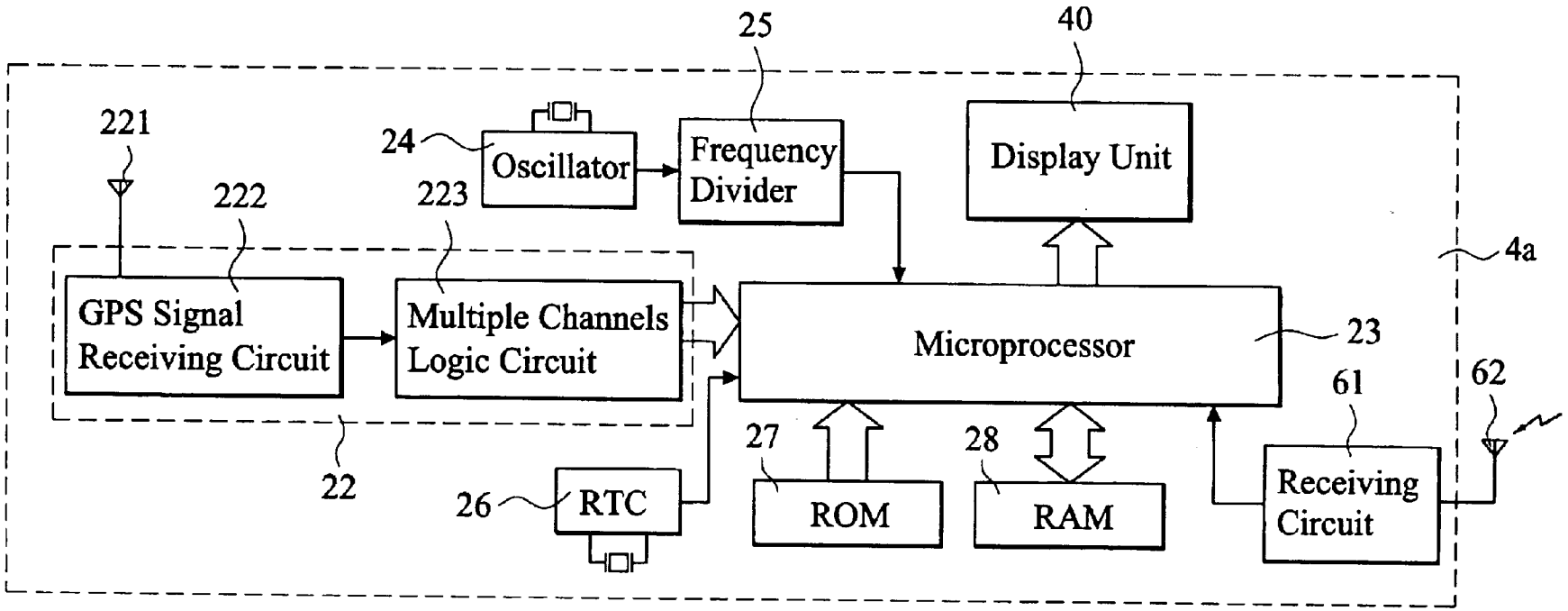
FIG. 6 is a block diagram for the signal-receiving module of the second embodiment of the present invention.

Please refer to FIGS. 5 and 6 that are block diagrams for a second embodiment of the present invention. In the second embodiment, there are included a wireless acceleration sensing device 21*a* mounted on the ski 1 at a suitable position thereof, and a signal-receiving module 4*a* worn on the skier's wrist. The signal-receiving module 4*a* includes a receiving circuit for receiving an acceleration signal transmitted from the wireless acceleration sensing device 21*a*.

The signal-receiving module 4*a* also includes a GPS signal receiver for receiving signals from the satellite 5. Based on the received acceleration signal and satellite signals, the signal-receiving module 4*a* displays at the display unit 40 the dynamic information about the skier's 3 coordinate position, speed, uphill and/or downhill inclination angle, and relative height during skiing.

As can be seen from the block diagram of FIG. 5, the wireless acceleration sensing device 21*a* includes an acceleration sensor 211, an amplifier 212, a filter 213, a PWM controller 214, a signal transmitter circuit 215, and a transmitting antenna 216. The acceleration sensor 211 is able to detect an acceleration signal and variation of inclination of the ski 1. The detected acceleration signal is amplified at the amplifier 212 and filtered at the filter 213, and the PWM controller 214 outputs the wave shape of the amplified and filtered acceleration signal, which is then transmitted by the signal transmitter circuit 215 via the transmitting antenna 216.

FIG. 6 is a block diagram for the signal-receiving module 4*a*. As shown, the signal-receiving module 4*a* includes a GPS signal-receiving module 22, which includes a GPS signal receiving antenna 221, a GPS signal receiving circuit 222, and a multiple channels logic circuit 223.

A GPS signal received by the GPS signal receiving circuit 222 via the antenna 221 passes the multiple channels logic circuit 223 and is sent to a microprocessor 23, which calculates information about the skier's current coordinate position, movement, speed, etc. based on the signal received by the GPS signal receiving circuit 222 and sent to the microprocessor 23.

The microprocessor 23 is also connected to an oscillator 24, a frequency divider 25, a real time clock controller 26, a read-only memory (ROM) 27, a random access memory (RAM) 28, a wireless acceleration signal receiving circuit 61, and a receiving antenna 62.

The microprocessor 23 receives the acceleration signal detected by the acceleration sensing device 21*a* via the wireless acceleration signal receiving circuit 61 and the receiving antenna 62, and calculates and processes the received acceleration signal based on the GPS signal detected by the GPS signal-receiving module 22 to obtain dynamic information about the skier's coordinate position, speed, uphill and/or downhill inclination angle, relative height, etc. during skiing. Such dynamic information about the skier's coordinate position, speed, uphill and/or downhill inclination angle, relative height, etc. during skiing is then displayed at the display unit 40.

Figure 7:
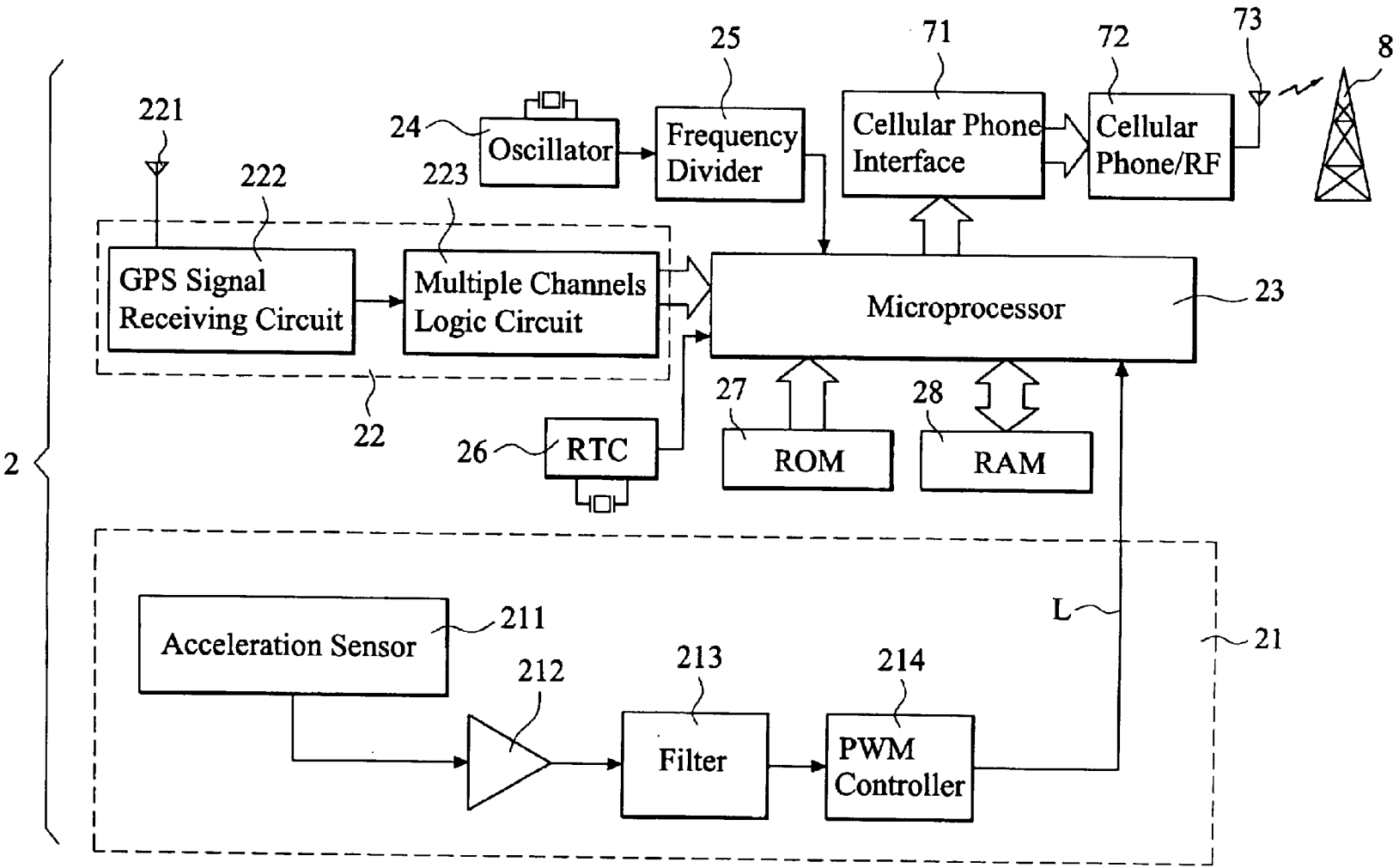
FIG. 7 is a block diagram for a third embodiment of the present invention.

The present invention further enables transmission of the skier's coordinate position and other dynamic information to a central control tower through data transmission via a mobile communication apparatus. FIG. 7 shows a block diagram for a third embodiment of the present invention. The third embodiment is generally similar to the first embodiment shown in FIG. 3, except that the microprocessor 23 in the skiing information sensing device 2 is further connected to a cellular phone interface 71, which is connected to a GPRS (General Packet Radio Service), a GSM (Global System for Mobile), or a RF (Radio Frequency) mobile communication apparatus 72. In this manner, the dynamic information about the skier's coordinate position, speed, uphill and/or downhill inclination angle, relative height, etc. calculated by the skiing information sensing device 2 may be transmitted to a remote central control tower 8 via the mobile communication apparatus 72 and an antenna 73 thereof. The third embodiment of the present invention is therefore particularly suitable for use in ski training, tracking, and rescue.

Figure 8:
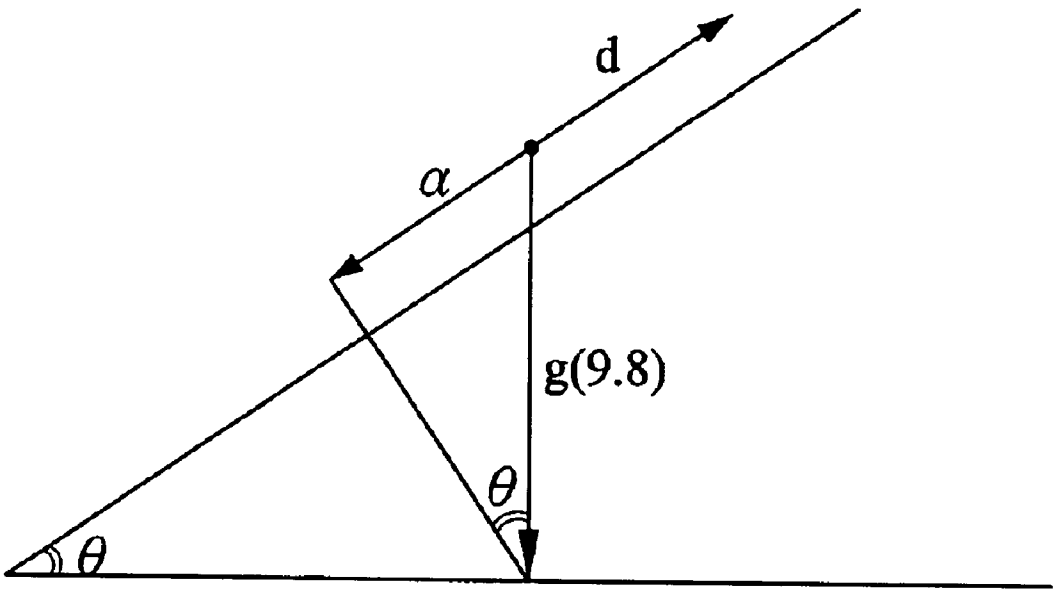
FIG. 8 schematically shows the use of the GPS signal received by the present invention, the acceleration signal detected by an acceleration-sensing module included in the present invention, and the acceleration of gravity to calculate uphill and/or downhill inclination angle during skiing.

In the present invention, the speed detected by the GPS signal-receiving module 22 is used to convert into a real speed of the skier 3 while skiing, and the acceleration signal detected by the acceleration sensing module 21 and the acceleration of gravity are used to calculate the uphill and/or downhill inclination angle. FIG. 8 explains the principle employed in the present invention to calculate the above data. From FIG. 8, it is derived that:

$$A=\alpha-d$$

$$\alpha=A+d$$

$$\text{Sin}\ \theta=\alpha/g$$

$$\theta=\text{Sin}^{-1}\ \alpha/g \qquad (1)$$

where $\theta$ is the inclination angle to be obtained;

g is the acceleration of gravity (a constant of 9.8)

A is the acceleration detected by the acceleration sensing module; and $\alpha$ is the acceleration of the ski detected by GPS.

There are two ways that can be adopted to calculate the inclination angle.

The first way of calculating the inclination angle includes the following steps:

(a) Read out the GPS signal to obtain data string of the speed over ground at time t1. The speed is initially shown in knot, and may be converted into kilometers or miles per hour (S1) by the conversion factor of 1 knot =1.8532 km.

(b) Read out the GPS signal to obtain data strings of the direction of movement output for determination of the skier's moving direction. In the case of a reverse moving direction, the above-mentioned speed over ground must also be shown with a reverse sign, that is, +or −.

(c) Then read out the GPS signal and convert to obtain the speed over ground in kilometers or miles per hour (S2) at time t2, and calculate the change in speed, i.e. S2−S1, and divide the change in speed by the difference in time (t2−t1) to obtain the acceleration of the ski (d), Put the above-mentioned acceleration of the ski (d) and the movement direction, into the aforesaid formula (1) to obtain the inclination angle θ, or the gradient of uphill or downhill.

The second way of calculating the inclination angle includes the following steps:

(a) Read out the GPS signal to obtain data about time and coordinate positions, etc.

(b) Obtain the skier's movements from differences between any two subsequent coordinate positions P1, P2, P3, etc. read within one unit time, and convert the movements into speed using integration. In consideration of possible errors, a mean of these movement values must be used as below:

$$S=[(P2-P1)+(P3-P2)+(P4-P3)+\ldots]/t\times 3600$$

where

P1, P2, P3 . . . are the skier's coordinate positions within one unit time (t);

t is the time in second by which the skier moves; and

S is the speed in kilometers/hour or miles/hour.

(c) Get the speed of the ski (S1'. S2') respectively at two different time (t1', t2'), and calculate the acceleration of the ski (d) by dividing the change in speed (S2'−S1') by the difference in time (t2'−t2').

Put the acceleration of the ski (d) into the aforesaid formula (1) to obtain the inclination angle θ, or the gradient of uphill and/or downhill, and the relative height.

In other words, in using the speed detected by the GPS to calculate the skier's real moving speed during skiing, the present invention may use either the data string of the speed over ground in the received GPS signals, or the time and coordinate positions in the received GPS signals to convert them into the skier's real skiing speed, and then employs the acceleration principle of the acceleration sensor and the acceleration of gravity to calculate the uphill and/or downhill inclination angle.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A dynamic information monitoring system adapted to monitor information about a skier during skiing, comprising:

an acceleration sensing module having an output terminal for output of an acceleration signal corresponding to a detected acceleration of a skier during skiing;

a GPS signal receiving module having an output terminal for output of received GPS signals;

a microprocessor coupled to said output terminal of said GPS signal receiving module for receiving said GPS signals therefrom, said microprocessor being coupled to said output terminal of said acceleration sensing module for receiving said acceleration signal therefrom, said microprocessor including calculating means for calculating dynamic information about the skier's current coordinate position, speed, uphill/downhill inclination angle, and relative height during skiing based on said received GPS signal and acceleration signal, said calculating means using said received GPS signals to compute a true speed of the skier during skiing at each of a plurality of different times, and then calculating an acceleration of the skier using a change in speed calculated between two different times, said calculating means using a combination of said calculated acceleration, said acceleration signal from said acceleration sensing module and a value for gravitational acceleration to calculate the uphill/downhill inclination angle of the skier's skis;

a wireless transmitter connected to said microprocessor for transmitting said calculated dynamic information about the skier's current coordinate position, speed, uphill/downhill inclination angle, and relative height during skiing; and a signal-receiving module for receiving said transmitted calculated dynamic information about the skier's current coordinate position speed uphill/downhill inclination angle, and relative height during skiing.

2. The dynamic information monitoring system as claimed in claim 1, wherein said microprocessor converts time and coordinate positions in said GPS signal received by said GPS signal receiving module into real speeds of the skier during skiing, and change in speed measured between two different times, and hence the acceleration of the ski is calculated, and by means of said acceleration of the ski, said acceleration signal received by said acceleration sensing module as well as the acceleration of gravity, the uphill and/or downhill inclination angle of a ski being used by said skier is calculated.

3. The dynamic information monitoring system as claimed in claim 1, wherein said acceleration sensing module, said GPS signal receiving module, said microprocessor, and said wireless transmitter are mounted on a ski at a predetermined position thereof for detecting an acceleration signal of said ski.

4. The dynamic information monitoring system as claimed in claim 1, wherein said signal-receiving module is worn on the skier's one wrist, and said signal-receiving module is provided at a top with a display unit.

5. The dynamic information monitoring system as claimed in claim 1, wherein said microprocessor is connected to a mobile communication apparatus via a cellular phone interface, so that said dynamic information about the skier's current coordinate position, speed, uphill and/or downhill inclination angle, relative height, etc. is transmitted to a remote central control tower via said mobile communication apparatus.

* * * * *